United States Patent [19]

Trahan

[11] Patent Number: 5,072,454

[45] Date of Patent: Dec. 17, 1991

[54] GARMENTS WITH APPENDAGE PORTIONS HAVING EXTENSIBLE FLEXIBLE JOINTS

[75] Inventor: Robert L. Trahan, Bedford, N.H.

[73] Assignee: Globe Manufacturing Company, Pittsfield, N.H.

[21] Appl. No.: 567,777

[22] Filed: Aug. 15, 1990

[51] Int. Cl.[5] ..... A41D 1/02

[52] U.S. Cl. ..... 2/70; 2/79; 2/81; 2/125; 2/227

[58] Field of Search ..... 2/70, 69, 79, 81, DIG. 4, 2/125, 126, 227

[56] References Cited

U.S. PATENT DOCUMENTS

| | | | |
|---|---|---|---|
| 1,169,256 | 1/1916 | Grimm et al. | 2/DIG. 4 |
| 1,508,834 | 9/1924 | Cohen | 2/125 |
| 1,900,931 | 3/1933 | Slanger | 2/DIG. 4 |
| 2,281,984 | 5/1942 | Martiny | 2/DIG. 4 |
| 2,314,226 | 3/1943 | Lee | 2/DIG. 4 |
| 4,709,421 | 12/1987 | Grilliot et al. | 2/81 |
| 4,729,130 | 3/1988 | Grilliot et al. | 2/81 |
| 4,817,210 | 4/1989 | Aldridge | 2/81 |
| 4,843,646 | 7/1989 | Grilliot et al. | 2/81 |
| 4,864,655 | 9/1989 | McKenney et al. | 2/81 |
| 4,922,552 | 5/1990 | Grilliot et al. | 2/81 |
| 4,959,876 | 10/1990 | Kalaam et al. | 2/81 |

*Primary Examiner*—Werner H. Schroeder
*Assistant Examiner*—Gloria Hale
*Attorney, Agent, or Firm*—Watson, Cole, Grindle & Watson

[57] ABSTRACT

A protective garment such as a coat or trousers adapted to be worn by firefighters and the like includes a torso-covering portion and an appendage-covering portion connected to the torso-covering portion, the appendage-covering portion having a generally rectangular aperture adapted to be positioned about at least a portion of a flexible joint of the appendage. The aperture has two significant dimensions perpendicular to each other and with a periphery and is filled with an insert secured to the appendage-covering portion about its periphery. The insert has a dimension in one direction which is greater than the dimension of the aperture in the same direction when the insert is secured in the aperture.

20 Claims, 2 Drawing Sheets

GARMENTS WITH APPENDAGE PORTIONS HAVING EXTENSIBLE FLEXIBLE JOINTS

The present invention relates to a construction for articles of apparel or garments and, more particularly, to a construction for protective garments which are adapted to be worn by firefighters such as, for example, coats, jackets, trousers and the like which may include an outer shell and a removable inner liner, the garments being provided with an area or portion of greater freedom of movement such as in the area of the knee or elbow.

While the present invention will be discussed hereinafter primarily in reference to particular constructions for coats and trousers, particularly protective coats and trousers adapted for use by firefighters, it should be recognized and understood that the use and application of the invention is not thereby so limited and that the subject invention may find utility in many other types of garments such as shirts, blouses, overalls and the like which are used in a variety of applications other than those encountered in firefighting situations.

In the construction of protective firefighter's coats and trousers as well as other garments, it is the general practice to have the garments comprise an outer shell made of fire-resistant and water-resistant material and a removable inner liner made of heat resistant material adapted to be inserted within the outer shell. While the outer shell and inner liner of the garment could easily be secured together, it is generally more convenient to have the shell and liner separable so that the liner can be easily dried after being subjected to moisture and allow the liner to be washed to so as to remove dirt and grime as well as accumulated perspiration.

As can be readily appreciated, such garments tend to be quite bulky and heavy due to their protective nature and thus tend to restrict the movement of the wearer. A significant problem oftentimes encountered in the use of such protective garments, particularly garments used by firefighters, is that movement of the appendages such as the arms and legs may be unduly restricted by the thickness and bulk of the protective garments. Restricted movement by the user is most often encounted at thoses areas of the appendages that are adapted to flex or bend on a repeated basis, particularly the areas of the elbows and knees, which are constantly being flexed in the course of fighting a fire. As a consequence of this reduced freedom of movement, the wearer of the garment tends to become more fatigued and less able to capably fight a fire the longer he is restricted in his movement by the garment being worn.

Various constructions have been proposed to provide greater freedom of movement in various types of garments, particularly in the areas of the elbow or knee where various body movements commonly cause these areas to flex or bend. For example, in U.S. Pat. No. 2,679,647 to Gossner, a waterproof suit is disclosed where the leg portions of the suit are provided with bellows or insert members in the forward center edges therof extending from the ankle portion to an appreciable distance above the knee portion, the members providing a greater freedom for expansion at the forward knee portion of the leg. As another example, U.S. Pat. No. 2,716,754 to Hirsch, ski pants are disclosed where each trouser leg at the region of the knee is provided with a transverse frontal split adapted to be closed by a slide fastener which when opened, allows a free knee bend when the user wishes to sit down. In addition, U.S. Pat. No. 4,117,552 to Simpson discloses an overall type garment of protective clothing where, in order to avoid damage or diminishment of viability due to mechanical pressure and to aid mobility, the undercoverall is provided with excess fabric over the outside knee and elbow joints by means of tucks in the front leg and hind sleeve panels which are far enough apart to ensure that the excess fabric coincides with the joint region for all joint positions in the particular size.

A drawback of these constructions for a garment, among others, is that they may tend to be difficult to properly construct, particularly on a a large scale basis typical of most commercial operations. In the case of protective garments, it is extremely important that suitable protection for the wearer is insured and when the garment construction requires pleats, tucks or other folded arrangements, such complete protection can not always be realized.

It is therefore a feature of the present invention to provide a construction for a protective garment such as a firefighter's coat or trousers which have greater space for movement in the areas of the elbows and knees and thus provide the wearer with greater mobility and freedom of movement.

It is another feature of the present invention to provide a construction for a garment such as a protective garment which will allow a projecting joint such as a knee or elbow to have greater freedom of movement without significantly increasing the overall size and or bulk of the garment.

It is yet feature of the present invention to provide a construction for a protective garment such as a firefighter's coat or trousers having portions allowing greater freedom of movement, which garment is relatively simply and easily constructed and manufactured, particularly in a commercial operation, and is also economically feasible to incorporate in the construction of a garment such as a protective garment.

SUMMARY OF THE INVENTION

Briefly, the present invention comprehends a garment adapted to be worn about a human body having at least one appendage with a flexible joint, the garment comprising a torso body-covering portion and an appendage-covering portion connected to the body portion, the appendage-covering portion having a generally rectangular aperture adapted to be about at least a portion of the flexible joint of the appendage, the aperture having two significant dimensions perpendicular to each other and with a periphery and being filled with a insert secured to the appendage-covering portion about the periphery of the aperture, the insert having a dimension in one direction which is greater than the dimension of the aperture in the same direction when the insert is secured in the aperture.

The subject invention further comprehends a garment adapted to be worn about a human body having at least one arm with a flexible elbow joint, the garment comprising an upper torso body-covering portion and an arm-covering portion connected to the body-covering portion, the arm covering portion having a generally rectangular aperture adapted to be about at least a portion of the elbow joint of the arm, the aperture having two significant dimensions perpendicular to each other and with a periphery and being filled with a insert secured to the arm covering portion about the periphery of the aperture, the insert having a dimension in one direction which is greater than the dimension of the aperture in the same direction when the insert is secured in the aperture.

The subject invention also comprehends a garment adapted to be worn about a human body having at least one appendage with a flexible joint, the garment comprising a torso body-covering portion and an appendage-covering portion connected to the body portion, the appendage-covering portion having an aperture adapted to be about at least a portion of the flexible joint of the appendage, the aperture having a periphery and being filled with a insert secured to the appendage-covering portion about its periphery, the insert having two opposed convex edges with a dimension between them which is greater than the dimension of the aperture in the same direction when the insert is secured in the aperture.

Further features, objects and advantages of the present invention will become more fully apparent from a detailed consideration of the arrangement and construction of the constituent parts as set forth in the following description taken together with the accompanying drawings.

DETAILED DESCRIPTION OF THE PREFERRED EMBODIMENTS

Figure 1:
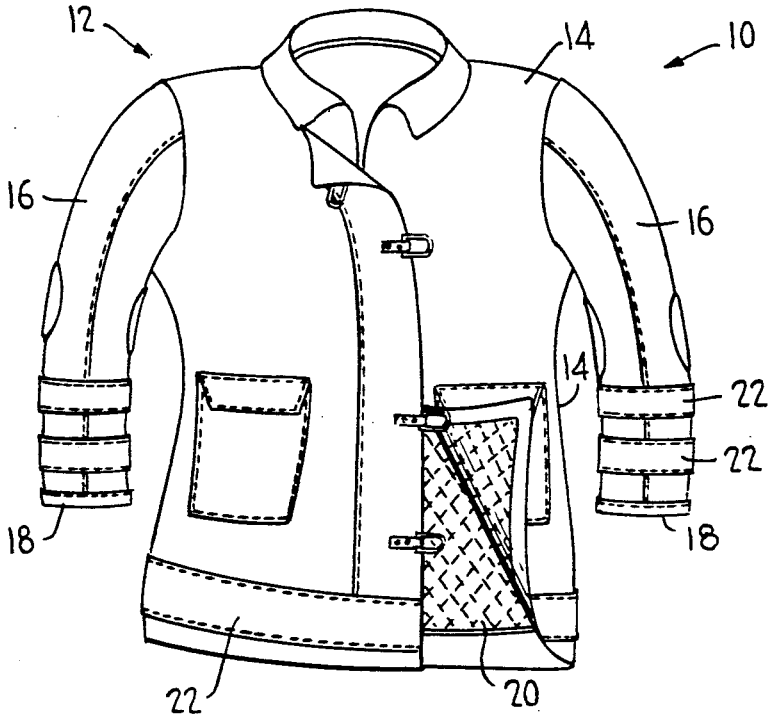
FIG. 1 is a front view of a firefighter's protective coat or jacket having a construction in accordance with the present invention.
Figure 2:
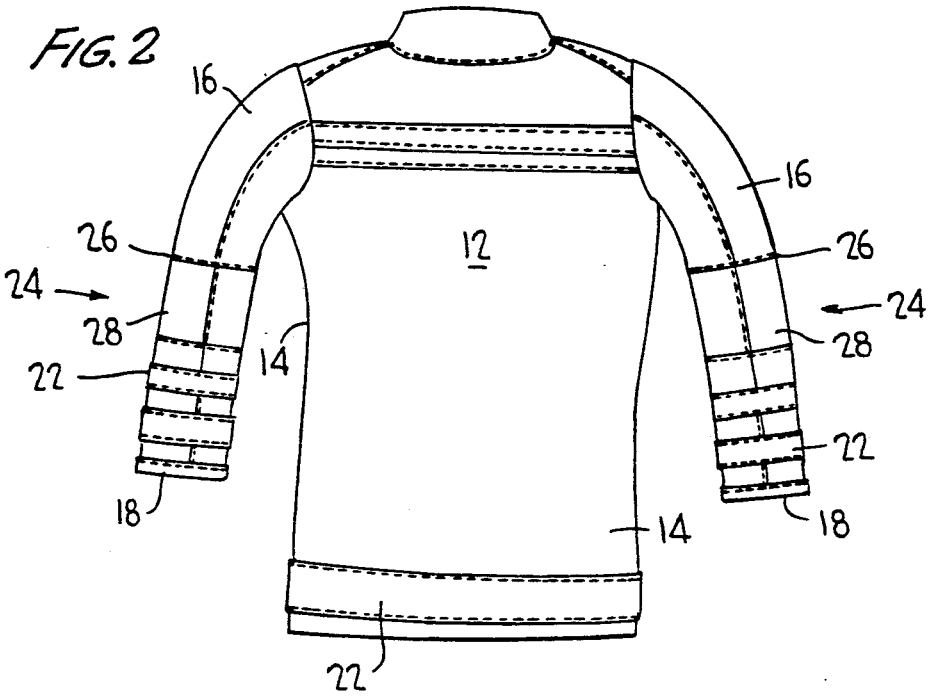
FIG. 2 is a back view of the firefighter's coat or jacket shown in FIG. 1.

Referring first to FIGS. 1 and 2, shown are front and back views of firefighter's coat or jacket 10 having a construction according to the present invention. Coat 10 in this illustrative embodiment includes outer shell 12 of a fabric adapted to resist flame and heat as well as repel water and water vapor so as to keep the firefighter dry. As is generally conventional, outer shell 12 of coat 10 includes body portion 14 adapted to be about the torso of a wearer and two sleeves 16 adapted to be about the wearer's arms and which are connected to the body portion. Sleeves 16 terminate in cuffs 18 having a layer of wear-resistant material such as leather thereover. Suitable materials for the shell 12 of coat 10 include an aramid fabric sold under the tradename "Nomex" by E. I. duPont de Nemours & Co., Wilmington, Del., U.S.A., which has been treated or coated with a water repellant finish such as neoprene to provide water-resistance.

Coat 10 also includes a removable inner liner 20 beneath outer shell 12 which, like the outer shell, comprises a body portion about the upper torso of a wearer and two attached arm portions. In FIG. 1, a portion of outer shell 12 is shown folded upwardly to illustrate part of liner 20. Preferably, inner liner 20 includes an inner layer of heat-insulating or heat resistant material, such as a woven fabric or quilt made of nylon-polyester or the previously mentioned "Nomex" aramid fibers, and an outer layer which functions as vapor barrier such as a neoprene-coated cotton/polyester or "Nomex" aramid or a layer of polymeric material sold under the tradename "Goretex" by W. L. Gore Co.

Coats 10 of the above type in terms of materials of construction and fabrication for outer shell 12 and inner liner 20 are described in U.S. Pat. No. 4,604,759 to Bowman et al and U.S. Pat. No. 4,774,725 to Page, both incorporated by their reference herein in their entirety. Preferably, various points or areas of the inner surface of outer shell 12 are releasably secured to the exterior of liner 20 by suitable fastening means such as a slide fastener or by other releasable fastening means such as snaps, buttons, hook and loop type fasteners sold under the tradename "Velcro" and the like.

Coat 10 may be further provided with fluorescent and light reflective horizontal bands, preferably made of orange, green or yellow "Reflexite" material sold by the Reflexite corporation, New Britain, Conn., U.S.A. or "Scotchlite" material sold by 3-M Corp., Minneapolis, Minn., U.S.A., which extend about sleeves 16 and lower and upper parts of body portion 14 for safety purposes. Bands 22 may also be oriented vertically and are secured to coat 10 by suitable means such as stitching and the like.

In accordance with the present invention, elbow portions of sleeves 16 both include areas 24 providing greater freedom of movement or flexibility for the elbow area of the coat. The arm portions or sleeves of this particular coat are made from two pieces of suitable fabric which are tailored and formed by securing the overlapping edges of the two pieces together with one seam in the front as shown in FIG. 1 and with one seam in back as shown in FIG. 2. The seams forming sleeve 16 generally extend from the armhole of the coat down to the wrist area. Sleeve 16 formed of the two pieces of fabric is then secured to the armhole of the torso or body portion of the coat. The seams forming the two piece sleeve arrangement are contoured to the slight curvature in the arm as it hangs in its natural or normal position at the side of the wearer.

Referring to FIGS. 1 and 2 of the embodiment shown, areas 24 providing greater freedom of movement flexibility in accordance with the present invention comprise an opening or aperture 26 formed in the arm portion or sleeve 16 of the coat which has been competely filled or covered in by insert 28. Aperture 26 in the coat is generally cut from the fabric in the general area of the back portion of the elbow, that is, that portion of the elbow joint which projects when the elbow is bent. Aperture 26 as shown is generally rectangular in shape, that is, having two significant dimensions perpendicular to each other, with its greater dimension preferably oriented in a direction transverse to the length of sleeve 16. Aperture 26 has a significant dimension in both directions as opposed to being a slit in the sleeve. Insert 28 fills in or covers aperture 26 and is secured thereto about its periphery by suitable means such as stitching, adhesives and the like. As will be explained hereinafter in greater detail, insert 28 is of a size and shape that the insert is domed or bulged outwardly when secured about aperture 26 and thus provides additional space within the sleeve in which the elbow can easily flex or bend.

Figure 3:
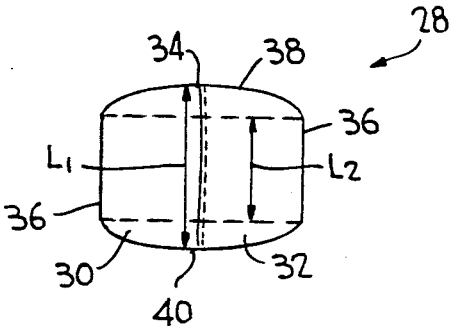
FIG. 3 is a detailed view of the insert used in the coat of FIGS. 1 and 2 to provide greater freedom of movement or flexibility in the elbow area of the coat.

A particularly preferred embodiment of insert 28 is shown in FIG. 3, the insert being shown in its essentially flat condition prior to being secured about its periphery in aperture 26 of sleeve 16. Insert 28 in this embodiment is formed in two segments 30 and 32 joined together along seam 34 by suitable means such as stitching, adhesives and the like. With segments 30 and 32 joined together, insert 28 has two lateral parallel edges or sides 36 and a convex upper edge or side 38 and a convex lower edge or side 40, the edges or sides forming the periphery of the insert. In this embodiment, seam 34 extends along the center line of the insert so that the right and left sides of the insert are mirror images of each other. Alternatively, seam 34 could extend along other lines such as a line parallel to the centerline or even oblique to the centerline. Furthermore, insert 28 could be of one piece rather than two segments, but for ease of constuction and installation two segments are presently preferred, particularly when seam 34 in insert 26 is colinear with the rear seam in sleeve 16 (see FIG. 2).

For the purposes of the present invention, it is important that the size of the insert be greater than the size of the aperture to which is secured in at least one direction. In the embodiment shown, the length $L_1$ of the centerline, the length of the seam 34, is significantly greater than the length $L_2$ of the lateral sides, that is, the distance between the dashed lines forming a rectangle with the lateral sides or edges, when the insert is utilized in an aperture having a dimension of $L_2$ in the same direction. This greater distance $L_1$ along the centerline insures that the insert, when secured about its periphery to aperture 26 in coat 10, provides the necessary space for greater freedom of movement for the elbow joint when flexed, that is, the shape of the insert allows more space for movement of the elbow. In other words, insert 28 of FIG. 3 is adapted to be secured within a rectangular aperture 26 having dimensions equal to the width of the insert and a height of $L_2$. For example, it has been found that in a firefighter's coat sized to fit a normal sized male, an insert having a centerline length $L_1$ of about five inches and when secured in an aperture having a dimension $L_2$ in the same direction of about four inches, provides sufficient freedom of movement for the wearer. It is also contemplated that the insert could have a greater dimension than the aperture in two directions and thus for a rectangular shaped aperture, the insert would have three or even four convex edges. In some embodiments, a generally circular insert of the appropriate size may be used.

Liner 20 adapted to worn beneath coat 10 would also be provided with a similar insert (not shown) in approximately the same position as insert 28 in the coat. Without such an insert in the liner, the advantages realized by the use of insert 28 in the coat would be significantly reduced. For most applications, the use of an insert formed of two segments in the liner is also generally preferred for ease of manufacturing and installation. However, an insert formed of a single piece of material could also be used in the liner.

The material used to form insert 28 may vary considerably. Oftentimes, it may be preferable to utilize the same material as used for shell of coat 10. For increased wear resistance, insert 28 may be made of a somewhat sturdier material such as leather, polymers and the like. Generally, the ease of fabrication and insertion into the aperture will tend to dictate which materials are best suited for use as an insert.

Figure 4:
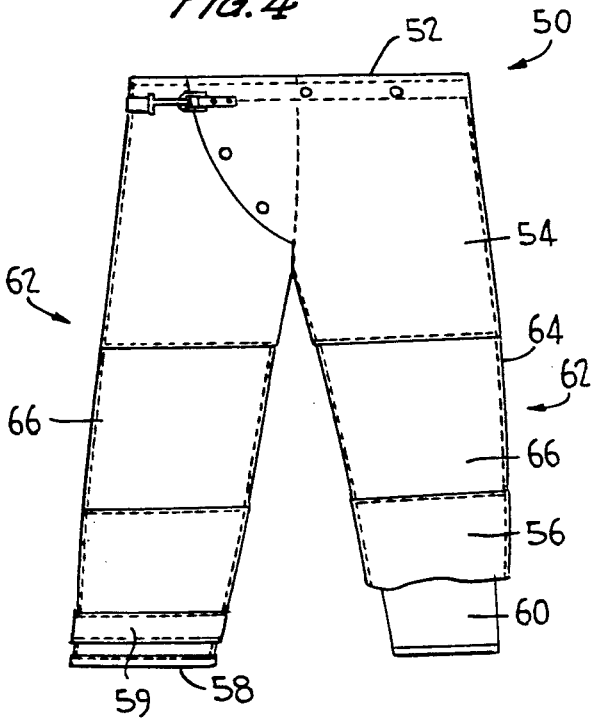
FIG. 4 is a front view a firefighter's protective trousers having a construction in accordance with the present invention, a portion of the outer shell having been removed to illustrate the liner.
Figure 5:
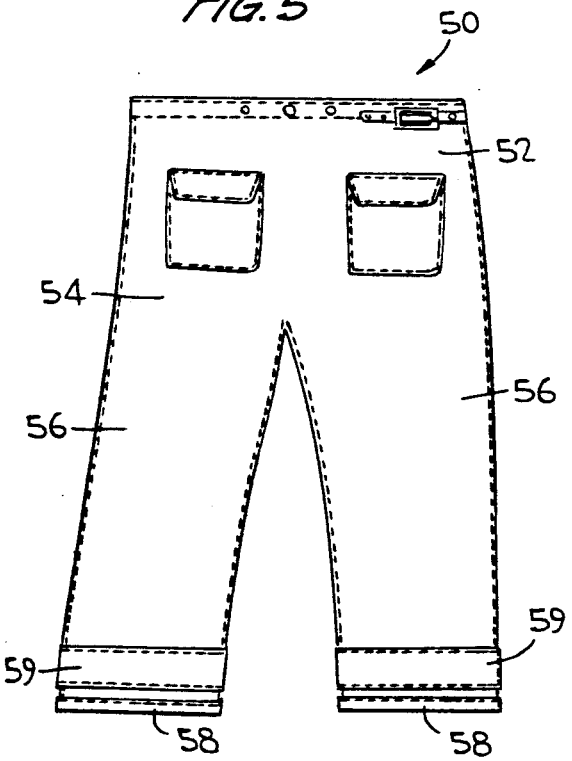
FIG. 5 is a back view of the firefighter's trousers shown in FIG. 4.

Turning now to FIG. 4, shown is the front of firefighter's trousers 50 having a construction according to the present invention. Trousers 50 in this illustrative embodiment, like coat 10, include outer shell 52 of a fabric adapted to resist flame and heat as well as repel water and water vapor so as to keep the firefighter dry. As is generally conventional, outer shell 52 of trousers 50 includes body encircling portion 54 adapted to be about the lower torso of a wearer and two generally tubular portions 56 adapted to be about the wearer's legs. Leg portions 56 of outer shell 52 terminate in cuffs 58 having a layer of wear-resistant material such as leather thereover. Trousers 50 also may have reflective band 59 about leg portion 56 in the area of the ankle. Suitable materials for outer shell 52 of trousers 50 include those mentioned above with reference to the materials for outer shell 12 of coat 10.

Trousers 40 also include removable liner beneath outer shell 52 which, like the outer shell, comprises a portion about the torso of a wearer and two attached leg portions. A portion of liner 60 is shown in FIG. 4 where part of the lower outer shell has been broken away for purposes of clarity. Liner 60 may be made of an inner layer of heat-insulating or heat-resistant material and an outer layer of a material forming a vapor barrier such as those mentioned above with reference to the materials for inner liner 20 of coat 10. Preferably, the outer shell 52 is releasably secured to the exterior of inner liner 60 by suitable fastening means such as a slide fastener as is or by other releasable fastening means such as snaps, buttons, hook and loop type fasteners sold under the tradename "Velcro" and the like.

In accordance with the present invention, the knee areas of leg portions 56 both include areas 62 providing greater freedom of movement or flexibility for the knee area of the trousers. Generally, the leg portions of conventional trousers are made by forming a piece of extending fabric into a tube-like arrangement and then sewing the overlapping edges of the fabric piece to secure them together. The inner seams forming this tube-like arrangement are generally positioned such that it extends to the crotch of the wearer between the legs, normally the seams extending together to a common point, the outer seams extending upwardly along the outside of the trousers. Areas 62 of greater freedom of movement in accordance with the present invention comprise aperture 64 formed in the leg portion of the trousers which has been filled by insert 66. Aperture 64 in leg portions 56 is generally cut from the fabric or formed in the general area of the front portion of the knee, that is, that portion of the knee joint which tends to project outwardly upon bending of the knee. Like aperture 26 in sleeves 16 of coat 10, aperture 64 as shown is generally rectangular in shape with its greater dimension preferably being in a direction parallel to the length of the leg portion. Aperture 64 has a significant dimension in both directions as to opposed to being a slit in the leg portion. Insert 66 fills in or covers aperture 64 and is secured thereto about its periphery by suitable means such as stitching, adhesives and the like. As will be explained hereinafter in greater detail, insert 66 is of a size and shape that the insert is domed or bulged outwardly when secured about the periphery of aperture 64 and thus provides additional space within the sleeve in which the elbow can easily flex or bend.

Figure 6:
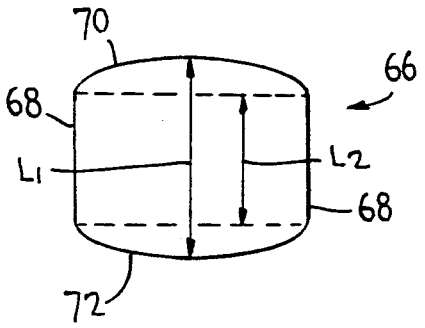
FIG. 6 is a detailed view of the insert used in the trousers of FIGS. 4 and 5 to provide greater freedom of movement or flexibility in the knee area of the trousers.

A particularly preferred embodiment of insert 66 is shown in FIG. 6, the insert being shown in its essentially flat condition prior to being secured in aperture 64 of trousers 50. Unlike insert 28, insert 66 as shown is formed of a single piece of material. Insert 66 has two lateral parallel sides 68 and a convex upper side 70 and a convex lower edge or side 72, the sides or edges forming the periphery for the insert. The insert could be of two or more segments rather than one piece but for ease of constuction, one piece is presently preferred.

For the purposes of the present invention, it is important that the length of the centerline between the convex edges in the embodiment shown be significantly greater than the length of the lateral sides, that is, the distance between the dashed lines forming a rectangle with the lateral sides or edges. This greater distance along the centerline insures that insert 66, when secured about its periphery to a rectangular aperture in trousers 50, provides the greater freedom of movement for the knee joint when flexed, that is, the shape of the insert allows more space for movement of the knee. For example, it has been found that in a firefighter's trousers sized to fit a normal sized male, an insert having a centerline length $L_1$ of about fourteen inches and side or edge length $L_2$ of about twelve inches within a slightly less than twelve inch aperture provides sufficient freedom of movement for the knee of the wearer.

Like insert 28, the material used to form insert 66 may vary considerably. Oftentimes, it is preferable to utilize the same material used for shell of trousers 50. For increased wear resistance, the insert may be made of a somewhat sturdier material such as leather, polymers and the like. Generally, the ease of fabrication will tend to dictate which materials are best suited for use as an insert. For knee areas which may experience significant wear, particularly in firefighter's trousers, wear resistant materials are presently preferred.

Liner 60 adapted to worn beneath trousers 10 would also be provided with a similar insert (not shown) in approximately the same position as insert 66 in the outer shell. Without such an insert in the liner 60, the advantages realized by the use of insert 66 in the shell of the trousers would be significantly reduced. For most applications, the use of an insert formed of a single piece of material in the liner is generally preferred for ease of manufacturing. However, an insert formed of two or more segments of material could also be used.

With a construction for a garment such as a coat or trousers which utilizes the present invention, the areas requiring greater freedom of movement such as the knee and elbow areas, are provided with a greater space in the portion of the garment which requires the greater freedom of movement in the course of normal activities. The size and shape of the inserts used in these areas tends to provide greater freedom of movement for those portions of the body adjacent thereto and tends to reduce the restrictiveness of the garment in the region where greater flexibility for the wearer is advantageous. Thus, the present invention provides areas of greater freedom of movement for a garment which are dimensioned so as to provide the greatest freedom of movement in the areas where the greatest stress caused by flexing or bending of the appendages. The resultant garment thereby tends to be neat and smooth in appearance and provides a more comfortable fit for the wearer during use. In addition, the wearer is less likely to become fatigued, particularly when engaged in a high activity endeavor such as fighting a fire, and also can exhibit greater dexterity so as to enable the wearer to operate with a higher degree of skill and effectiveness.

While there has been shown and described what is considered to be preferred embodiments of the present invention, it will be apparent to those skilled in the art to which the invention pertains that various changes and modifications may be made therein without departing from the invention as defined in the appended claims.

I claim:

1. A garment to be worn about a human body having a torso and at least one appendage with a flexible joint, the garment comprising a torso-covering portion and an appendage-covering portion connected to the torso-covering portion, the appendage-covering portion having a generally rectangular aperture positioned about at least a portion of the flexible joint of the appendage, the aperture having two significant dimensions perpendicular to each other and with a periphery and being filled with an insert secured to the appendage-covering portion about its periphery, the insert having a dimension in one direction which is greater than the dimension of the aperture in the same direction when the appendage-covering portion is not flexed.

2. A garment according to claim 1, wherein said garment is in the form of trousers.

3. A garment according to claim 2, wherein the insert has at least one convex edge extending in the greater dimension of the insert.

4. A garment according to claim 3, wherein the insert has two opposed parallel side edges and two opposed convex edges.

5. A garment according to claim 2, wherein the torso-covering portion and the appendage-covering portion each include a liner and an outer shell, both the outer shell and the liner including an insert secured within an aperture.

6. A garment according to claim 5, wherein the insert has at least one convex edge extending in the greater dimension of the insert.

7. A garment according to claim 6, wherein the insert has two opposed parallel side edges and two opposed convex edges.

8. A garment according to claim 1, wherein the insert has at least one convex edge extending in the greater dimension of the insert.

9. A garment according to claim 8, wherein the insert has two opposed parallel side edges and two opposed convex edges.

10. A garment to be worn about a human body having at least one arm with a flexible elbow joint, the garment comprising an upper torso body-covering portion and an arm-covering portion connected to the body portion, the arm-covering portion having a generally rectangular aperture positioned about at least a portion of the elbow joint of the arm, the aperture having two significant dimensions perpendicular to each other and with a periphery and being filled with an insert secured to the appendage-covering portion about its periphery, the insert having a dimension in one direction which is greater than the dimension of the aperture in the same direction when the arm-covering portion is not flexed.

11. A garment according to claim 10, wherein the insert has at least one convex edge extending in the greater dimension of the insert.

12. A garment according to claim 11, wherein the insert has two opposed parallel side edges and two opposed convex edges.

13. A garment according to claim 12, wherein the insert is formed of two segments secured together.

14. A garment according to claim 10, wherein the body-covering portion and the arm-covering portion each include a liner and an outer shell, both the outer shell and the liner including an insert secured within an aperture.

15. A garment according to claim 14, wherein the insert has at least one convex edge extending in the greater dimension of the insert.

16. A garment according to claim 15, wherein the insert has two opposed parallel side edges and two opposed convex edges.

17. A garment to be worn about a human body having at least one appendage with a flexible joint, the garment comprising a torso-covering portion and an appendage-covering portion connected to the torso-covering portion, the appendage-covering portion having an aperture positioned about at least a portion of the flexible joint of the appendage, the aperture having a periphery and being filled with an insert secured to the appendage-covering portion about its periphery, the insert having two opposed convex edges with a dimension between them which is greater than the dimension of the aperture in the same direction when the insert is secured in the aperture.

18. A garment according to claim 17, wherein the aperture is generally rectangular, having two dimensions, and the insert further includes two generally parallel opposed edges, with a dimension between the parallel edges approximately equal to the other dimension of the aperture.

19. A garment according to claim 17, wherein the torso-covering portion and the appendage-covering portion each include a liner and an outer shell, both the outer shell and the liner including an insert secured within an aperture.

20. A garment according to claim 19, wherein the apertures in the liner and in the outer shell are generally rectangular, having two significant dimensions, and the inserts further include two generally parallel opposed edges, with a dimension between the parallel edges approximately equal to the other dimension of the aperture.

* * * * *